US009612082B2

(12) United States Patent
Cottle

(10) Patent No.: US 9,612,082 B2
(45) Date of Patent: Apr. 4, 2017

(54) ADJUSTABLE SLIDE-ACTION STOCK FOR FIREARMS

(71) Applicant: Slide Fire Solutions, LP, Moran, TX (US)

(72) Inventor: Jeremiah Cottle, Moran, TX (US)

(73) Assignee: Slide Fire Solutions LP, Moran, TX (US)

( * ) Notice: Subject to any disclaimer, the term of this patent is extended or adjusted under 35 U.S.C. 154(b) by 68 days.

(21) Appl. No.: 14/442,680

(22) PCT Filed: Sep. 12, 2013

(86) PCT No.: PCT/US2013/069964

§ 371 (c)(1),
(2) Date: May 13, 2015

(87) PCT Pub. No.: WO2014/078462

PCT Pub. Date: May 22, 2014

(65) Prior Publication Data

US 2016/0273875 A1 Sep. 22, 2016

Related U.S. Application Data

(60) Provisional application No. 61/876,897, filed on Sep. 12, 2013, provisional application No. 61/726,827, filed on Nov. 15, 2012.

(51) Int. Cl.
*F41C 23/14* (2006.01)
*F41C 23/10* (2006.01)

(52) U.S. Cl.
CPC ..... *F41C 23/14* (2013.01); *F41C 23/10* (2013.01)

(58) Field of Classification Search
CPC ..... F41C 23/14; F41C 23/10
(Continued)

(56) References Cited

U.S. PATENT DOCUMENTS 554,068 A 2/1896 Kimball
981,210 A 1/1911 Menteyne et al.
(Continued)

FOREIGN PATENT DOCUMENTS

WO 2012050670 A2 4/2012

OTHER PUBLICATIONS

Public Online forum, http://uzitalk.com/forums/archive/index.php/t-24944.html, "Akins Accelerator Critical Update," posted Feb. 9, 2007 to Jan. 22, 2008 by online user Vegas SMG as viewed on Apr. 19, 2016.
"Bump Firing"; Purported internet discussion thread. Jan. 21, 2004 by online user "Packrat".
(Continued)

*Primary Examiner* — Samir Abdosh
(74) *Attorney, Agent, or Firm* — Endurance Law Group, PLC

(57) ABSTRACT

A slide-action stock assembly for a semi-automatic firearm enables adjustment of the trigger pull length. An adjustable length interface interconnects a commercial off-the-shelf shoulder stock with a conjoined pistol grip and finger rest into a handle unit that slidably supports the firing unit portion of the firearm. The adjustable length interface includes a stem that is constrained to back-and-forth movement within a stem channel under the buffer tube. The stem includes a row of holes into which a plunger of the adjustable shoulder stock is set by the user to achieve a desired trigger pull length. A lock-out feature selectively impedes the slide-action mode. The finger rest can be positioned on either the right or left side of the pistol grip.

20 Claims, 13 Drawing Sheets

(58) Field of Classification Search
USPC ..... 42/73
See application file for complete search history.

(56) References Cited

U.S. PATENT DOCUMENTS 1,447,861 A 3/1923 Johnston
1,587,009 A 1/1926 Bobbe
1,587,003 A 6/1926 Kewish
2,220,663 A 11/1940 Rossmanith
2,270,707 A 1/1942 Humski
2,361,985 A 11/1944 Birkigt
2,465,487 A 3/1949 Sampson et al.
2,465,587 A 3/1949 Sampson et al.
2,491,492 A * 12/1949 Gaidos ..... F41A 3/82 42/75.01
2,874,502 A 2/1959 Lockwood
2,970,398 A 2/1961 Crouch
3,031,786 A 5/1962 Robert
3,348,328 A * 10/1967 Earl Roy ..... F41C 23/04 42/73
3,507,067 A 4/1970 Into
3,683,535 A 8/1972 Lewis
3,731,588 A 5/1973 Curtis et al.
3,785,243 A 1/1974 Christakos
4,002,101 A 1/1977 Tellie
4,344,351 A 8/1982 Mcqueen
4,532,852 A 8/1985 Hance et al.
4,553,468 A 11/1985 Castellano et al.
4,579,037 A 4/1986 Gillum
4,601,123 A 7/1986 Swearengen et al.
4,787,288 A 11/1988 Miller
4,803,910 A 2/1989 Troncoso
4,823,671 A 4/1989 Buryta
5,074,190 A 12/1991 Troncoso
5,092,052 A 3/1992 Godsey
5,433,134 A 7/1995 Leiter
5,560,136 A 10/1996 Cupp
5,630,406 A 5/1997 Dumont
5,726,377 A * 3/1998 Harris ..... F41A 19/14 42/65
5,780,762 A 7/1998 Kobayashi
5,852,891 A 12/1998 Onishi et al.
5,979,098 A 11/1999 Griggs
6,101,918 A 8/2000 Akins
6,164,002 A 12/2000 Troncoso
6,189,525 B1 2/2001 Kutrubes
6,318,014 B1 11/2001 Porter
6,553,707 B1 * 4/2003 Tseng ..... F41C 23/12 124/27
6,662,485 B2 * 12/2003 Kay ..... F41C 23/20 42/75.03
6,732,466 B2 * 5/2004 Bentley ..... F41C 23/04 42/74
6,807,762 B1 10/2004 Edwards
6,807,763 B1 10/2004 Leung
6,966,138 B1 11/2005 Deckard
7,162,822 B1 * 1/2007 Heayn ..... F41C 23/04 42/71.01
7,213,498 B1 * 5/2007 Davies ..... F41A 3/94 42/74
7,225,574 B2 6/2007 Crandall et al.
7,273,002 B1 9/2007 Rogers
7,340,857 B1 3/2008 Bentley
7,398,723 B1 7/2008 Blakely
7,478,495 B1 * 1/2009 Alzamora ..... F41C 23/06 42/74
7,562,614 B2 7/2009 Polston
7,596,900 B2 10/2009 Robinson et al.
7,673,413 B2 * 3/2010 Bentley ..... F41C 23/06 42/72
7,762,018 B1 * 7/2010 Fitzpatrick ..... F41A 11/02 42/73
7,805,873 B2 10/2010 Bentley
7,823,313 B2 * 11/2010 Faifer ..... F41C 23/06 42/1.06
7,966,760 B2 6/2011 Fitzpatrick et al.
D645,110 S 9/2011 Cook et al.
8,051,593 B2 11/2011 Vesligaj
8,127,658 B1 * 3/2012 Cottle ..... F41A 19/11 42/69.01
8,176,835 B1 5/2012 Cottle
8,356,542 B2 1/2013 Cottle et al.
8,371,208 B2 2/2013 Cottle
8,448,562 B2 5/2013 Cottle
8,459,171 B2 6/2013 Cottle
8,474,169 B2 7/2013 Cottle et al.
8,555,541 B2 10/2013 Ingram
8,806,791 B2 8/2014 Cottle
8,950,099 B2 * 2/2015 Rogers ..... F41C 23/04 42/71.01
8,955,245 B2 * 2/2015 Chvala ..... F41C 23/14 42/1.06
9,091,505 B1 7/2015 Battaglia
9,121,663 B2 * 9/2015 Troy ..... F41C 23/14
9,207,042 B1 12/2015 Erskine
9,410,763 B2 * 8/2016 Colt ..... F41C 23/04
2003/0101631 A1 * 6/2003 Fitzpatrick ..... F41C 23/04 42/72
2004/0055200 A1 * 3/2004 Fitzpatrick ..... F41C 23/04 42/72
2005/0183312 A1 8/2005 Speaks
2005/0235546 A1 10/2005 Wonisch et al.
2006/0010749 A1 * 1/2006 Kincel ..... F41C 23/22 42/71.01
2006/0123683 A1 6/2006 Garrett et al.
2006/0248772 A1 11/2006 Curry
2007/0084101 A1 4/2007 Pikielny
2007/0101631 A1 * 5/2007 Bentley ..... F41C 23/14 42/74
2007/0138219 A1 6/2007 Kovalchuk et al.
2007/0261284 A1 * 11/2007 Keng ..... F41C 23/04 42/73
2007/0266845 A1 11/2007 Polston
2008/0110074 A1 * 5/2008 Bucholtz ..... F41C 23/06 42/1.06
2009/0126249 A1 5/2009 Crommett
2009/0139128 A1 6/2009 Fluhr
2009/0255161 A1 10/2009 Fitzpatrick et al.
2009/0313872 A1 12/2009 Goertz
2010/0071246 A1 3/2010 Vesligaj
2010/0205846 A1 8/2010 Fitzpatrick et al.
2010/0229444 A1 9/2010 Faifer
2010/0242328 A1 9/2010 Faifer
2010/0242333 A1 9/2010 Kincel
2011/0067226 A1 3/2011 Westbrook
2011/0113665 A1 * 5/2011 Cottle ..... F41C 23/04 42/73
2011/0167704 A1 7/2011 Chupp
2011/0173863 A1 7/2011 Ingram
2011/0185618 A1 8/2011 Jamison et al.
2011/0225865 A1 9/2011 Williams
2011/0283587 A1 11/2011 Sharp et al.
2012/0000108 A1 1/2012 Zusman
2012/0000109 A1 1/2012 Zusman
2012/0042556 A1 2/2012 Vesligaj
2012/0186122 A1 7/2012 Zamlinsky et al.
2012/0260793 A1 10/2012 Gomez
2013/0047379 A1 2/2013 Zilke
2013/0074685 A1 3/2013 Cottle
2013/0097911 A1 4/2013 Larue
2013/0288204 A1 10/2013 Taylor
2014/0007763 A1 1/2014 Foster
2014/0082983 A1 3/2014 Ermossa
2014/0259848 A1 * 9/2014 Chvala ..... F41C 23/14 42/73
2016/0187099 A1 * 6/2016 Cottle ..... F41C 23/14 42/73

OTHER PUBLICATIONS

"Can You Bump Fire a Ruger 10/22?"; Purported internet discussion thread. Mar. 7, 2007 by online user "rugerdude".

(56) References Cited

OTHER PUBLICATIONS

"Hellfire System"; Purported Internet discussion thread. Mar. 31, 1997 by online user "GOJPO".
"[Archived Thread]—My Akins Accelerated 10/22 can kick your 10/22 ass . . ." Purported internet discussion thread. Aug. 13-22, 2006. (Copyright); Relevant pages may include p. 3 of 5. [http://www.ar15.com/forums/t_6_11/203814_.html].
"Akins Accelerator Decision v 2.0"; Purported internet discussion thread. Jan. 9-Jun. 30, 2007. [http://thefiringline.com/forums/archive/index.php?t-234087.html].
"Another neutered Akins accelerator FS"; Purported internet discussion thread. Jan. 19-30, 2009. [http://1919a4.com/showthread.php?21872-Another-neutered-Akins-accelerator-FS].
"ATF reverses decision . . ."; Purported internet discussion thread. Dec. 6-24, 2006. [http://www.thehighroad.org/archive/index.php/t-240357.html].
"Bill_Akins > albums > Private concepts"; Purported video posted to internet. Oct. 16, 2008. [http://good-times.webshots.com/video/3011228380099763970axOjzH].
"Just Wanted to Show Off My Bumpfiring Toy"; Purported internet discussion thread with embedded videos. Nov. 13, 2008-May 14, 2010; Relevant pages may include p. 1 of 2. [http://forum.saiga-12.com/index.php?/topic/31610-just-wanted-to-show-off-my-bumpfiring-toy-p/].
"More Thoughts on the Akins Accelerator"; Purported internet discussion thread. May 29, 2008-Sep. 25, 2009. [http://armsandthelaw.com/archives/2008/05/atkins_accelera.php].
"Screw the ATF and 1022"; Purported internet discussion thread. Apr. 10-11, 2007. [http://www.thehighroad.org/archive/index.php/t-268573.html].
"Turn in Your Killer Springs Here"; Purported internet discussion thread. Jan. 9-10, 2007. [http://www.thehighroad.org/archive/index.php/t-246764.html].
Michael Foeller II letter from US US Department of Justice, Bureau of Alcohol, Tobacco, Firearms and Explosives, Jun. 18, 2008.
Michael Johnson letter from US Department of Justice, Bureau of Alcohol, Tobacco, Firearms and Explosives, Jun. 26, 2008.

* cited by examiner

ADJUSTABLE SLIDE-ACTION STOCK FOR FIREARMS

CROSS REFERENCE TO RELATED APPLICATIONS

This application claims priority to Provisional Patent Application No. 61/726,827 filed Nov. 15, 2012 and Provisional Patent Application No. 61/876,897 filed Sep. 12, 2013 the entire disclosure of both applications are hereby incorporated by reference and relied upon.

BACKGROUND OF THE INVENTION

Field of the Invention

The present invention relates generally to firearms, and more particularly toward a manually reciprocated gun stock for controlled rapid fire of a semi-automatic firearm.

Description of Related Art

Various techniques and devices have been developed to increase the firing rate of semi-automatic firearms. Slide Fire Solutions LP, of Moran, Tex., Applicant of this present invention, markets a proprietary slide-action stock under the trademark SLIDE FIRE. The SLIDE FIRE slide-action stock is described for example in detail in US 2012/0240442, published Sep. 27, 2012 and US 2012/0311907 published Dec. 13, 2012, the entire disclosures of which are hereby incorporated by reference and relied upon.

The slide-action stocks in these exemplary citations include a shoulder stock having a rearwardly facing butt end adapted to be pressed into the shoulder of a user, a pistol grip adapted to be grasped by the user's hand, and a finger rest configured to stabilize the end of a user's trigger finger stretched in front of the trigger of the firearm while the remaining fingers of the user's hand clench the pistol grip. The shoulder stock and pistol grip and finger rest are fixed together as a monolithic handle unit that, in use, is held tight to the user's body. When used in a rapid-fire slide-action mode of operation, the firing unit portion of the firearm—namely the barrel, receiver and trigger—are manually reciprocated back-and-forth in the handle unit in counterpoise with the recoil from each fired round of ammunition. The distance between the butt end of the shoulder stock and pistol grip is fixed in the prior art examples. That is, the trigger pull length, which is generally defined as the distance between butt end of the shoulder stock and the trigger in a center-fire rifle, is non-adjustable. As a result, users with exceptionally long or short arms, or that wear especially thick clothing, could find the firearm fit to be less than ideal. Shooting accuracy may suffer as a result of poor fit.

Adjustable and/or collapsible shoulder stocks are made for non-slide-action semi-automatic long rifles, including as two examples those produced by Magpul, Inc. and Tapco, Inc. Such prior art adjustable shoulder stocks usually include a lever-actuated latch that is manipulated by the user to selectively place a small plunger in any one of several adjustment holes aligned in a row along the bottom of a buffer tube (or of a comparable tube-like feature) that extends rearwardly from the firearm receiver. To adjust the shoulder stock length, i.e., the trigger pull length, a user manually withdraws the plunger (via the lever actuator of the latch) against a spring force then slides the shoulder stock to a preferred adjusted length position. Upon release of the lever actuator, the plunger seats in the nearest adjustment hole thus securing the shoulder stock in the length-adjusted position.

Such prior art adjustable shoulder stocks are generally incompatible with a slide-action reciprocating handle. For one reason, slide-action handles may use the same row of adjustment holes along the buffer tube (or tube-like feature) as a lock-out feature to selectively impede the slide-action mode of operation. Another reason that prior art adjustable shoulder stocks have been deemed incompatible with a slide-action reciprocating handles is that there has been no effective way to couple the prior art adjustable stock to the pistol grip and to a finger rest as a monolithic handle unit while incorporating a reciprocating interface with the firing unit portion of the firearm. While those not well-acquainted with the art may naively suppose design of an adjustable slide-action handle to be a relatively straightforward engineering exercise, such is in fact not at all readily apparent to the skilled artisan due, at least in part, to the requirements that shoulder stock and pistol grip be integrated into a monolithic handle unit that, in use, remains held tight to the user's body while the firing unit portion of the firearm rapidly reciprocates back-and-forth. A still further reason that prior art adjustable shoulder stocks have been deemed incompatible with slide-action reciprocating handles is that a prior art adjustable shoulder stock is intended to be locked relative to the firing unit in an adjusted position for use. A shoulder stock locked in position relative to the firing unit would impede slide-action shooting.

Therefore, there exists a continuing need for further improvements in devices that will allow a firearms user to practice slide-action shooting in the most effective manner possible, and in which users of varying arm lengths may experience the sport with proper fit.

BRIEF SUMMARY OF THE INVENTION

The invention contemplates a slide-action stock assembly for a semi-automatic firearm having a longitudinally reciprocating trigger. The assembly includes a shoulder stock having a rearwardly facing butt end adapted to be pressed into the shoulder of a user. A pistol grip is adapted to be grasped by the user's hand, and a finger rest is configured to stabilize the end of the user's trigger finger stretched in front of the trigger of the firearm while the remaining fingers of the user's hand clench the pistol grip. The shoulder stock and the pistol grip and the finger rest are fixed together as a unit relative to the longitudinally reciprocating firearm trigger when in a rapid-fire slide-action mode of operation. The improvement comprises an adjustable length interface that interconnects the shoulder stock and the pistol grip. The adjustable length interface is selectively operable to change the distance between the butt end of the shoulder stock and the pistol grip to adapt the assembly to suit a user's comfort preference without impeding the slide-action mode of operation.

The slide-action stock assembly includes an adjustable length interface between the shoulder stock and the pistol grip to selectively change the trigger pull distance. Using this assembly, a user may adjust the trigger pull to fit their skeletal system within a slide-action stock application in order to comfortably practice rapid fire shooting. The slide-action stock assembly provides semi-automatic firearm users with a custom fit for the handle unit that, in use, is held tight to the user's body while a firing unit portion of the firearm rapidly reciprocates back-and-forth. The assembly thus provides increased usability, enjoyment and shooting accuracy.

The invention also contemplates a method for supporting the firing unit portion of a semi-automatic firearm for slide-action rapid fire. The method comprises the steps of: providing a semi-automatic firearm having a firing unit comprising a barrel and a trigger and a receiver, connecting a shoulder stock and a pistol grip and a finger rest together as a handle unit, the shoulder stock having a rearwardly facing butt end, supporting the firing unit in the handle unit for longitudinal reciprocating movement when in a rapid-fire slide-action mode of operation, and adjusting the distance between the butt end of the shoulder stock and the pistol grip to adapt the handle unit to suit a user's comfort preference without impeding the slide-action mode of operation.

In one optional embodiment, the adjustable length interface is configured to accept commercial, off-the-shelf, adjustable shoulder stocks. Users accustomed to a favored prior art adjustable shoulder stock (for non-slide-action firearm platforms), may utilize their preferred old adjustable stock on a slide-action platform.

BRIEF DESCRIPTION OF THE SEVERAL VIEWS OF THE DRAWINGS

These and other features and advantages of the present invention will become more readily appreciated when considered in connection with the following detailed description and appended drawings, wherein.

DETAILED DESCRIPTION OF THE INVENTION

Figure 1:
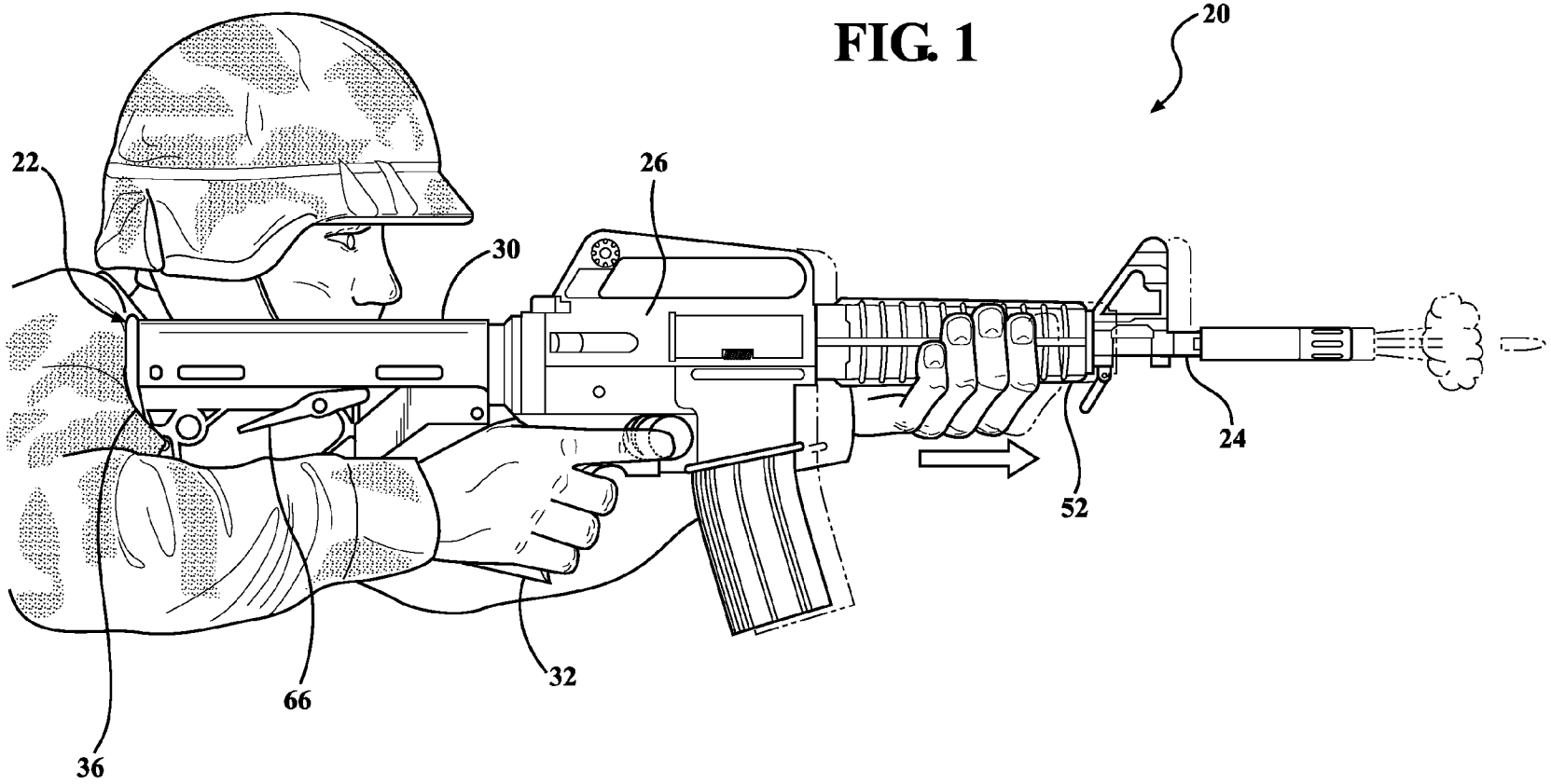
FIG. 1 is a side view of a slide-action stock assembly according to a first embodiment of this invention fitted to an AR-15 type rifle and being fired by a user.

Referring to the Figures, wherein like reference numerals indicate like or corresponding parts throughout the several views, a user is shown in FIG. 1 operating a semi-automatic firearm, generally shown at 20, that is configured for slide-action shooting. It will be understood that the principles of this invention are adaptable to many different makes and models of firearms. A first embodiment of the invention depicted in FIGS. 1-8 is configured specifically for use with the AR-15 style firearm 20. The AR-15 is a popular platform; however the invention may be practiced with other makes and models of firearms given corresponding modifications that will be apparent to an ordinarily skilled gunsmith.

The firearm 20 is composed of two main components: a firing unit and a handle unit, generally indicated at 22. The firing unit comprises those components which, in the slide-action mode of operation, are manually reciprocated back-and-forth in the handle unit in counterpoise with the recoil from each fired round of ammunition. The elements of the firing unit include a barrel 24, a receiver 26 and a trigger 28. In AR-platforms, receiver 26 may be further defined as having separable upper and lower parts.

The handle unit 22 comprises those elements which, in use, are intended to be held tight to the user's body as illustrated in FIG. 1. The handle unit 22 includes a shoulder stock 30 and a pistol grip 32 and a finger rest 34. The shoulder stock 30 has a rearwardly facing butt end 36 adapted to be pressed into the shoulder of a user, and the pistol grip 32 is adapted to be grasped by the user's same hand. For a person that shoots right-handed, the user's right shoulder will seat the butt end 36 of the shoulder stock 30 and the user's right hand will grasp the pistol grip 32. The finger rest 34 is configured to stabilize the end of the user's trigger finger as it is stretched in front of the trigger 28 of the firearm 20 while his or her remaining fingers clench the pistol grip 32. The components of the handle unit 22 are fixed together in use so that they form a somewhat monolithic unit, meaning that they are locked in unitary relationship with one another to provide a sturdy feature for the user to hold and aim the firearm 20.

A slide-action interface is established between the handle unit 22 and the firing unit. The slide-action interface may take many forms, but in the first embodiment is presented as comprising two discrete, spaced apart features: an interface block 38 and a buffer tube 40. As perhaps best shown in FIG. 4, the interface block 38 is configured to mount by screw 42 to the grip mounting lug 44 on a standard AR-15 (or AR-10) receiver 26 lower. Upon removing the original equipment (OE) pistol grip (not shown) from the mounting lug 24, the interface block 38 is affixed in its place to form a first linear bearing surface upon which the handle unit 22 slideably fits. The pistol grip 32 is formed with a block pocket 46 that is shaped to mate with the interface block 38 in a smooth sliding fit. The block pocket 46 is perhaps best shown in FIG. 5.

Figure 3:
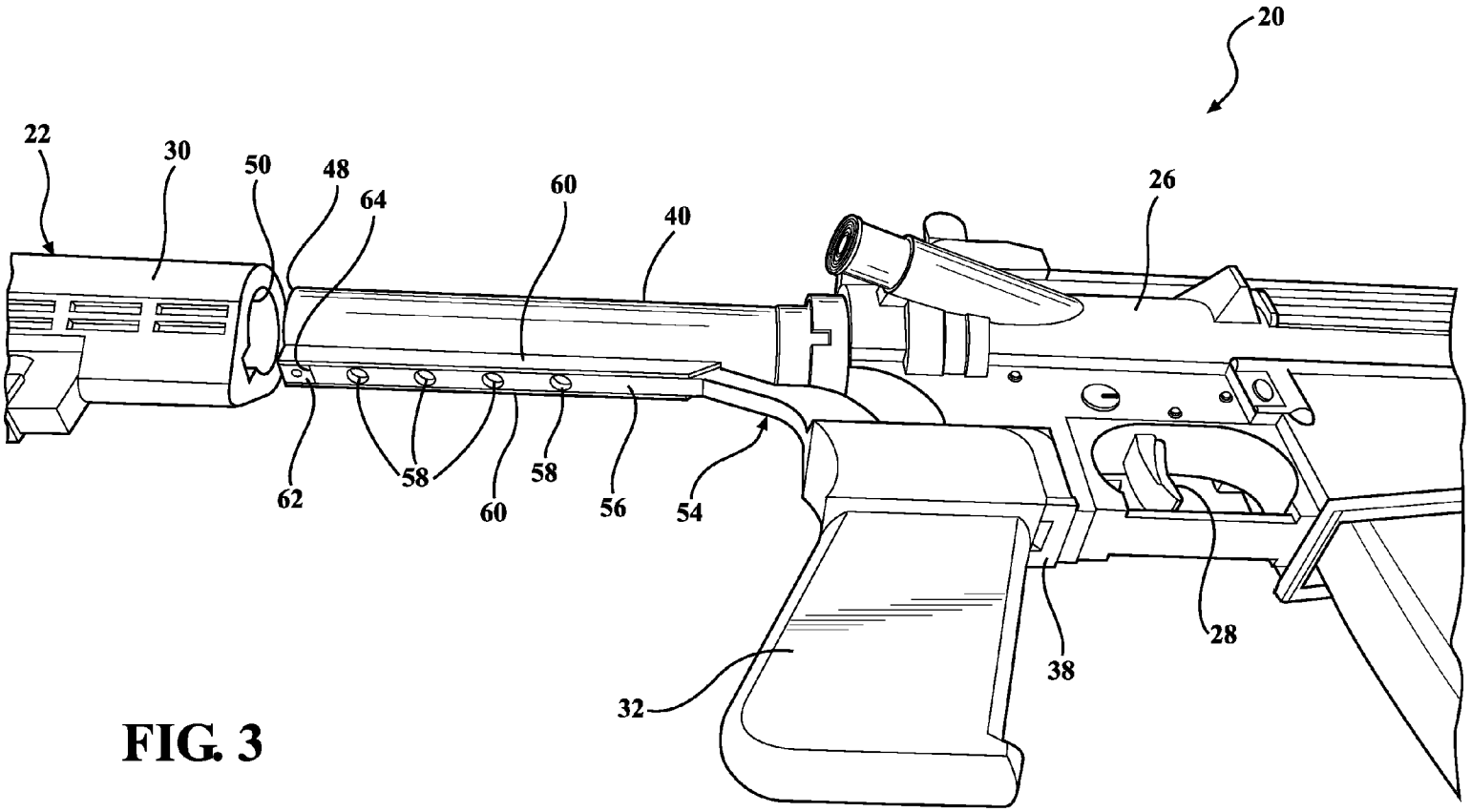
FIG. 3 is a fragmentary, partially exploded view showing the adjustable length interface feature.
Figure 4:
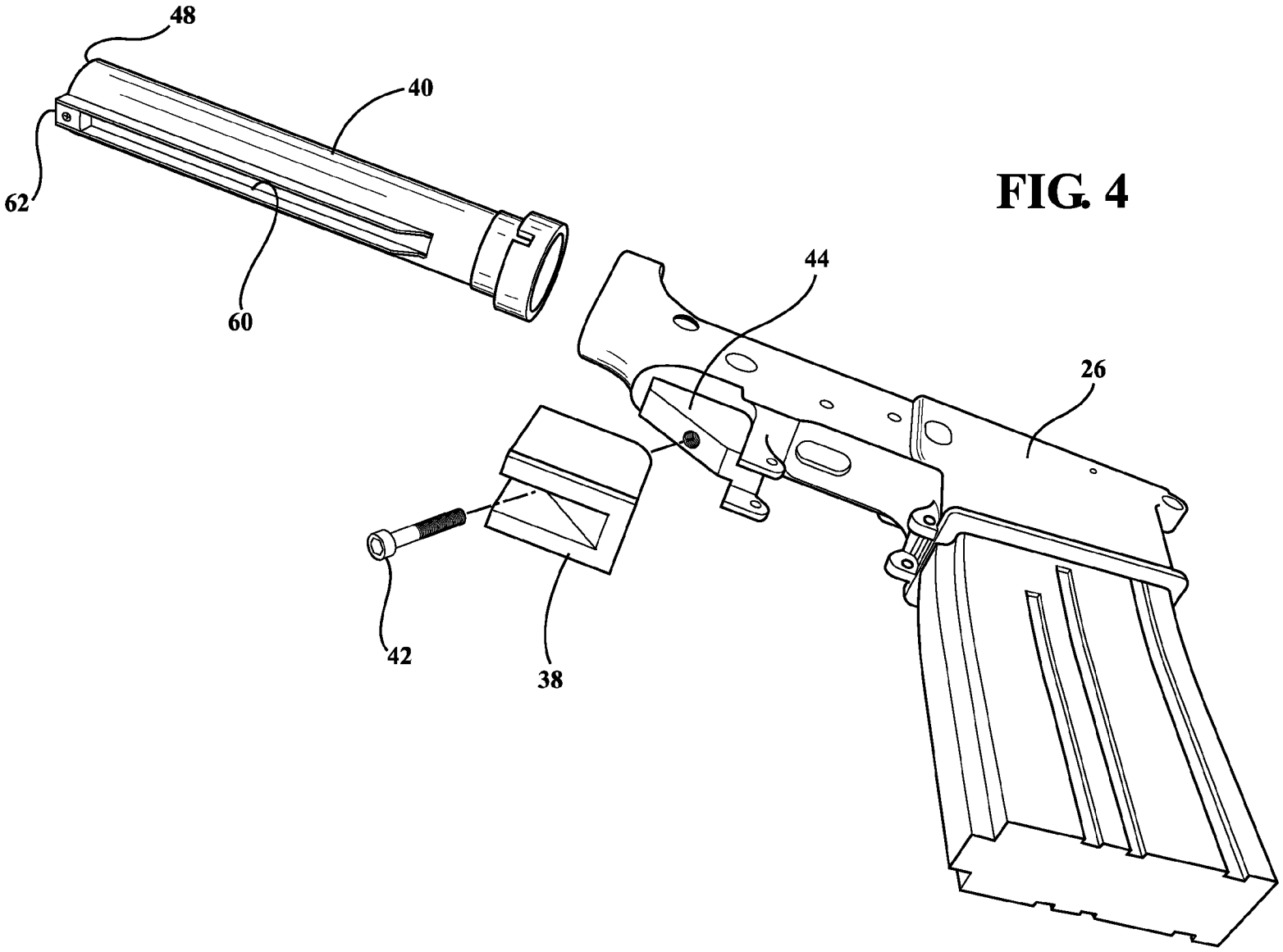
FIG. 4 is a perspective view of the lower receiver of an AR-15 style rifle with the buffer tube and interface block exploded therefrom.
Figure 5:
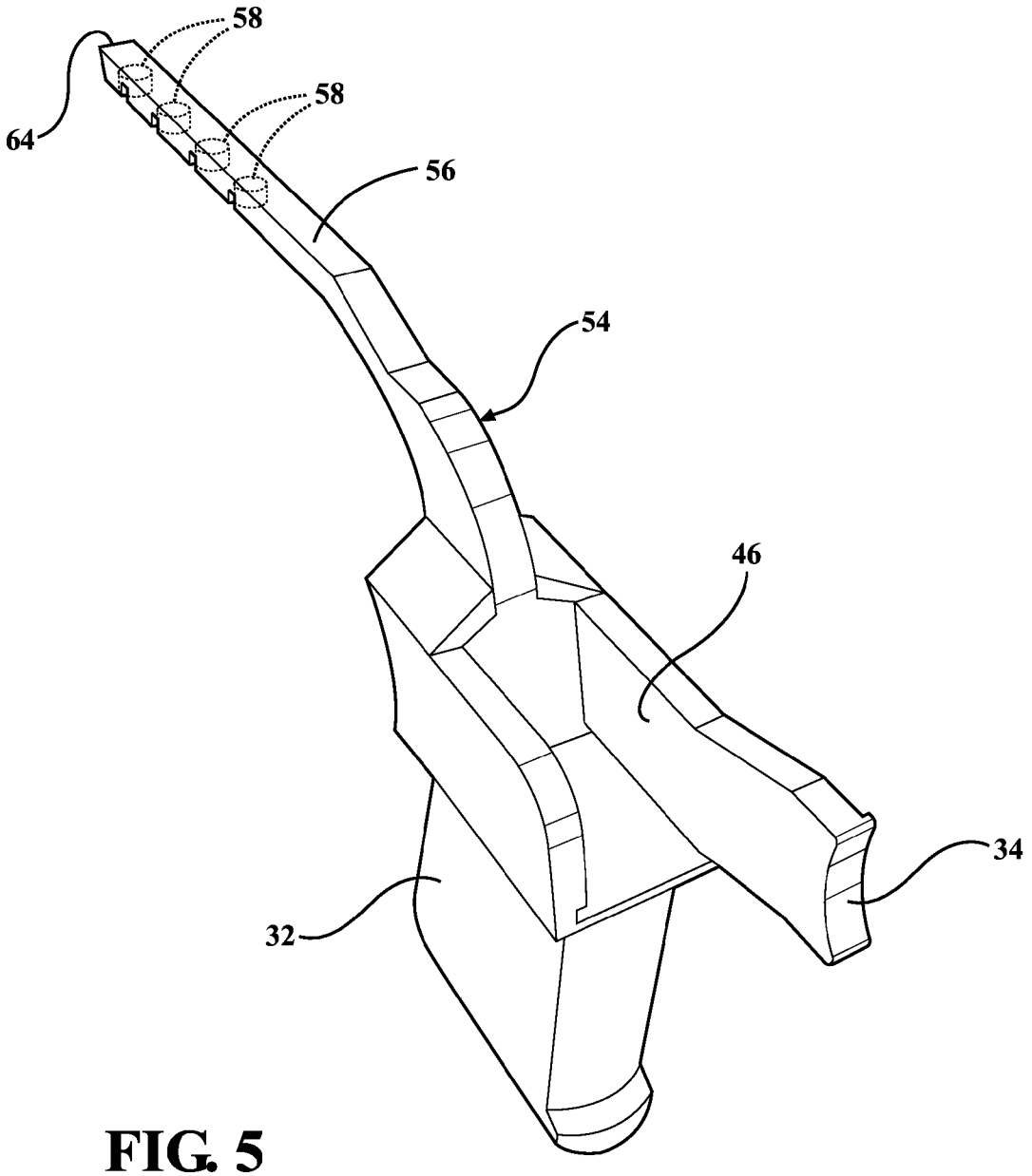
FIG. 5 is a perspective view of pistol grip, stem and finger rest according to the first embodiment of the invention.
Figure 6:
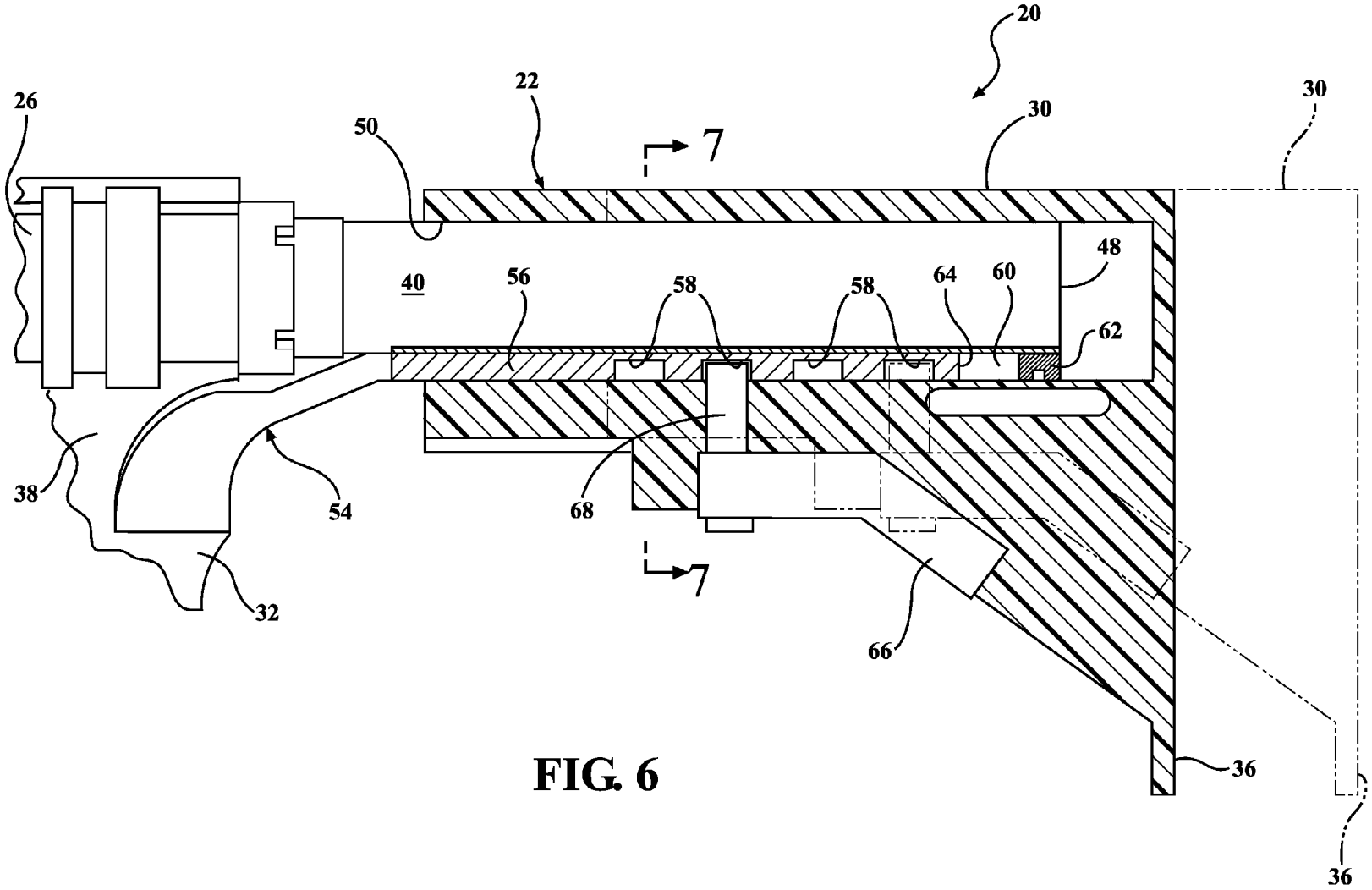
FIG. 6 is a cross-sectional view through the adjustable shoulder stock with the shoulder stock portion length-adjusted in phantom to lengthen the trigger pull.
Figure 7:
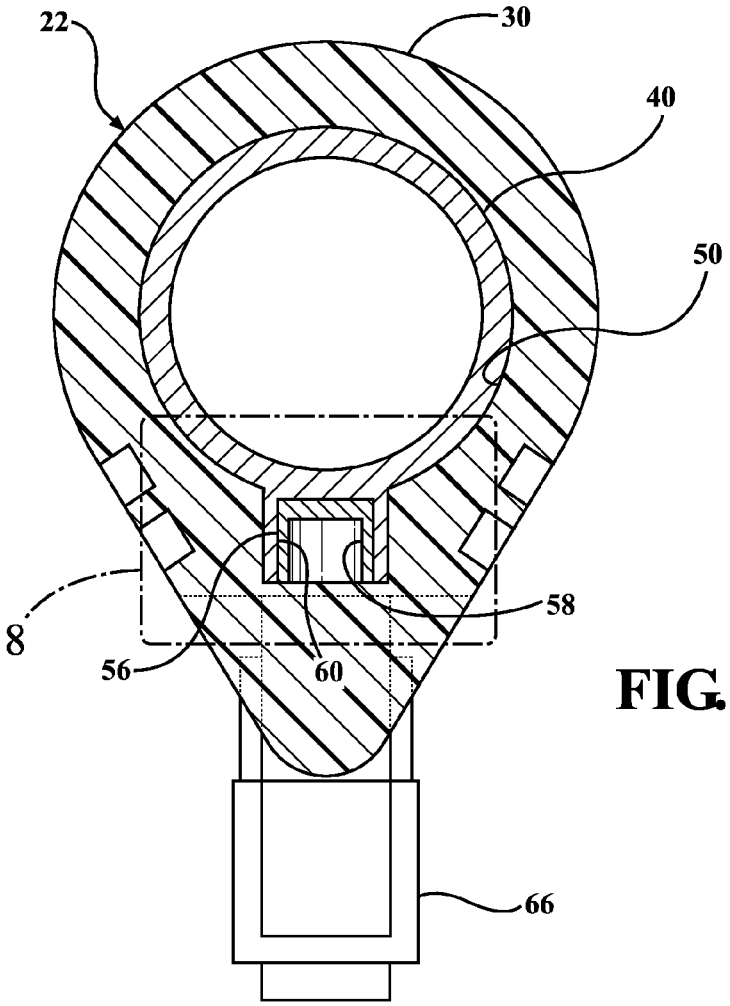
FIG. 7 is a cross-section view taken generally along lines 7-7 of FIG. 6.
Figure 8:
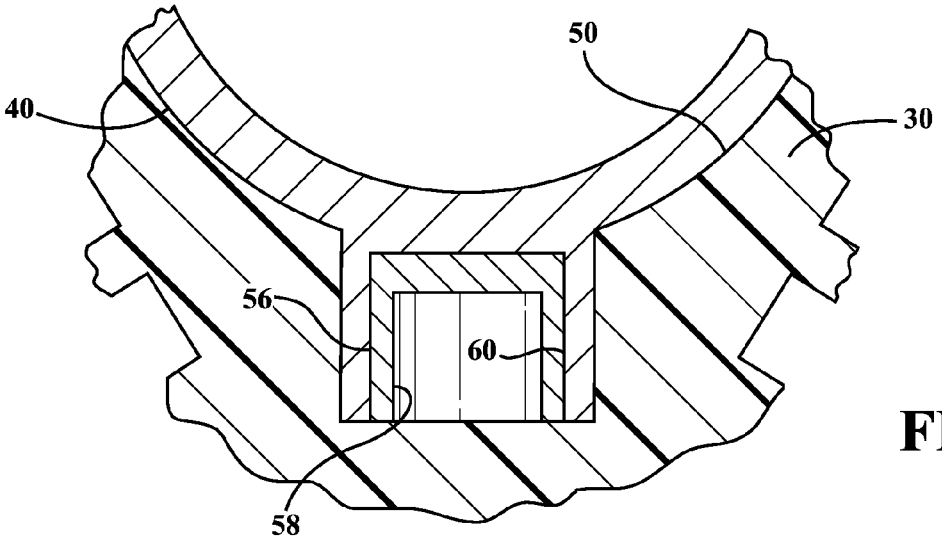
FIG. 8 is a an enlarged view of the area indicated at 8 in FIG. 7.

In AR-platform firearms 20, the buffer tube 40—sometimes referred to as a lower receiver extension—is part of a buffer assembly that counteracts the bolt-carrier group (not shown). The buffer tube 40 houses an internal buffer spring (not shown) that extends rearwardly from the lower receiver 26. As will be described subsequently, non-AR platform firearms may be fitted with a rearward extension from the receiver which may or may not be part of its buffer assembly. Nevertheless, such rearward extending features that form part of the slide-action interface with the handle unit 22 in non-AR platforms will also be referred to as a "buffer tube" for convenience and consistency. In FIGS. 3, 4 and 6, the buffer tube 40 is shown as a generally cylindrical, tube-like member that joins the receiver 26 at a forward end and that terminates at a closed rear or terminal end 48. The shoulder stock 30 is provided with a passage 50 that receives the buffer tube 40 with a smooth sliding fit. Thus, the shoulder stock 30 fits over the buffer tube 40 in something of a sleeve-like manner and is able to slide back-and-forth thereon via the sliding fit established by the passage 50.

Accordingly, the slide-action interface established by the combined features of the interface block 38 and buffer tube 40 allow the firing unit to reciprocate back-and-forth in the handle unit 22. A user holding the firearm 20 as shown in FIG. 1 may thus shoot in slide-action mode by tightly gripping the handle unit 22 as shown in FIG. 1 and forcibly pushing forward on a front hand guard or grip 52 located under the barrel 24 (or other convenient grip location on the firing unit). For a person that shoots right-handed, the user's left hand will clench the front hand guard 52. If the user's forward push on the front hand guard 52 has a lower force magnitude than the recoil force of the fired cartridge, the recoil will overpower the forward push and allow the firing unit to slide backwards in the handle unit 22 by an inch or so, thus allowing the trigger 28 to re-set. Once the recoil force subsides, the user's forward push on the front hand guard 46 causes the firing unit to slide forwardly in the handle unit 22 where the user's trigger finger perched on the finger rest 34 is poised to collide with the trigger 28 and re-peat the firing cycle.

An adjustable length interface, generally indicated at 54, interconnects the shoulder stock 30 and the pistol grip 32. The adjustable length interface 54 is selectively operable by a user to change the distance between the butt end 36 of the shoulder stock 30 and the pistol grip 32, or more particularly between the butt end 36 and the trigger 28, to adapt the handle unit 22 to suit a user's comfort preference without impeding the slide-action mode of operation. The adjustable length interface 54 is provided so that a user can selectively change the trigger pull distance of the firearm 20. Using this feature, a user may shorten or lengthen the trigger pull to fit their skeletal system within a slide-action stock application in order to comfortably practice rapid fire shooting. The slide-action stock assembly enables the user to achieve a custom fit for the handle unit 22, thus improving usability, enjoyment and shooting accuracy.

The adjustable length interface 54 may take many forms, but in this first embodiment of FIGS. 1-8 is shown including an elongated stem 56 that extends rearwardly from the pistol grip 32 and underlies a bottom edge of the buffer tube 40. The stem 56 is configured as a rod-like feature made of a rigid material and having a generally square or rectangular cross-section (see FIG. 8). A plurality of adjustment holes 58 are formed in a row along the bottom of the stem 56. When fitted to a firearm 20, the adjustment holes 58 are located in the same general region of, and correspond generally in size and shape to, the typical holes found in the adjustment rail section of a prior art OE mil-spec buffer tube (not shown).

The buffer tube 40 may be formed with a stem channel 60. In this first embodiment, the stem channel 60 slidably supports the left and right sides of the stem 56 for relative reciprocating movement during slide-action operation of the firearm 20. In other words, the stem channel 60 serves to prevent the stem 56, and in turn the entire handle unit 22, from rotating around the buffer tube 40. As perhaps best shown in FIGS. 4, 7 and 8, the stem channel 60 comprises thin fins or walls that sandwich the stem 56 in an optimal position along the bottom edge of the buffer tube 40. A stem stop 62 may be formed in the stem channel 60 adjacent the terminal end 48 of the buffer tube 40, as shown in FIGS. 3, 4 and 6. A distal end 64 of the stem 56 opposes the stem stop 62 as one of possibly several means to limit forward movement of the firing unit in the handle unit 22. The stem stop 62 may be removable to aid in assembly. The passage 50 of the shoulder stock 30 is shaped something like a keyhole, i.e., round with a notched bottom, to concurrently slide over the combined buffer tube 40 and stem channel 60 and stem 56. In this manner, the shoulder stock 30 surrounds, at least partially, buffer tube 40 and stem channel 60 and stem 56.

The shoulder stock 30 includes a latch 66 that may be lever-actuated or otherwise deployed. The latch 66 includes a spring-loaded plunger 68 that is manipulated by the user to selectively engage any one of the several adjustment holes 58 aligned in a row along the bottom of the stem 56. In this manner, the shoulder stock 30 portion of the handle unit 22 may, optionally, be selected from among any of the numerous commercially available prior art style adjustable shoulder stocks. FIG. 6 illustrates in cross-section an exemplary commercially available adjustable shoulder stock 30 designed to slide over the end of an OE mil-spec buffer tube. Examples of prior art style adjustable shoulder stock assemblies may be found in U.S. Pat. Nos. 3,348,328 and 7,162,822, the entire disclosures of which are hereby incorporated by reference. Thus, users accustomed to a favored prior art adjustable shoulder stock (for non-slide-action firearm platforms), may utilize their preferred old adjustable stock 30 on the slide-action platform enabled by the present invention.

Figure 2:
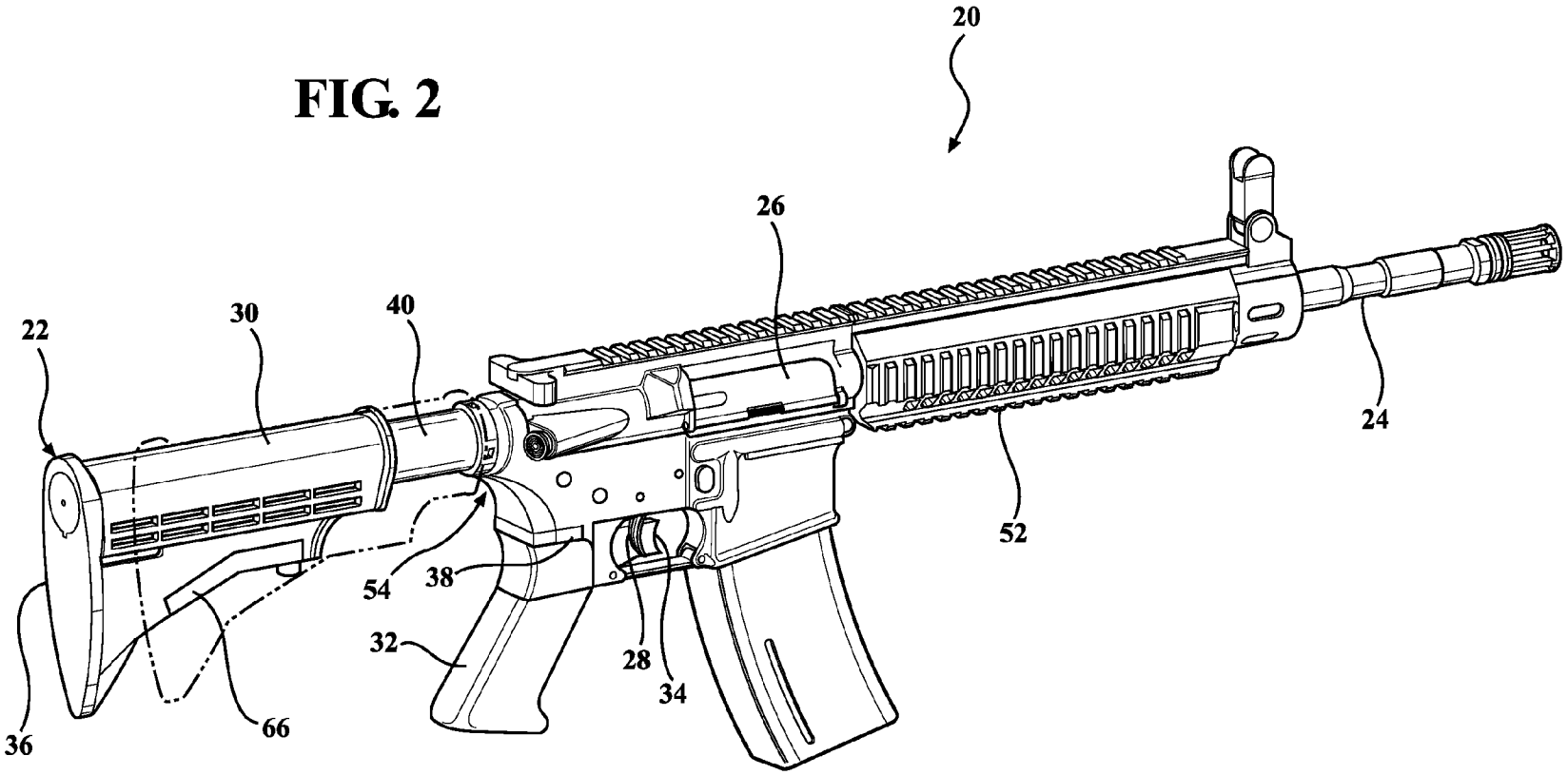
FIG. 2 is a side view of slide-action stock assembly fitted to an AR-15 type rifle with the shoulder stock portion length-adjusted in phantom to shorten the trigger pull.

To adjust the shoulder stock length, i.e., the trigger pull length, a user manually withdraws the plunger 68 (via the lever actuator of the latch 66) against a spring force then slides the shoulder stock 30 to a preferred adjusted length position such as suggested in phantom in FIGS. 2 and 6. Upon release of the lever actuator of the latch 66, the plunger 68 seats in the nearest adjustment hole 58 thus securing the shoulder stock 30 in a preferred length-adjusted position. The plunger 68 is preferably engageable with any one of the plurality of adjustment holes 58 in the stem 56.

In the slide-action mode of operation, the firing unit rapidly reciprocates within the handle unit 22, which in turn is held tight to the user's body as depicted in FIG. 1. The slide-action interface, i.e., those bearing-like features that support a smooth sliding action, include the interface block 38 within the block pocket 46, and the buffer tube 40 within the round portion of the passage 50, and the stem channel 60 flanking the stem 56. These interacting surfaces operate in concert to maintain a smooth and stable sliding action which is advantageous for slide-action shooting.

Although the figures illustrate the pistol grip 32 and finger rest 34 and stem 56 portions as a one-piece integral construction, it should be understood that these components may be composed of multiple interchangeable modules. As with most things, people have preferences when it comes to semi-automatic firearms. Practically speaking, it would be somewhat inefficient and expensive to manufacture a different pistol grip 32 and finger rest 34 and stem 56 sub-unit to suit the wide variety of consumer tastes. Therefore, a contemplated modular design can be implemented with interchangeable components, with each component, or module, offered in various styles to meet the demands of diverse users. One contemplated example is that the stem 56 is a more-or-less universal part but the pistol grip 32 and finger rest 34 each come in a variety of sizes and styles. The finger rest 34 for example could be manufactured in interchangeable left-hand and right-hand versions. The pistol grip 32 could be made from various colors, materials, sizes, etc., and interchanged at will by the user. It is contemplated that more or fewer modules may be used without departing from the spirit of this invention. A snap-fit or screw-fastener or other type of connection could be used so that the components can be assembled (and disassembled) without tools, but nevertheless hold together securely in use. And as previously mentioned, the shoulder stock 30 can be selected from among any of numerous commercially available types. Those of skill in the manufacturing arts will envision alternative ways in which the component modules can be implemented.

Figure 9:
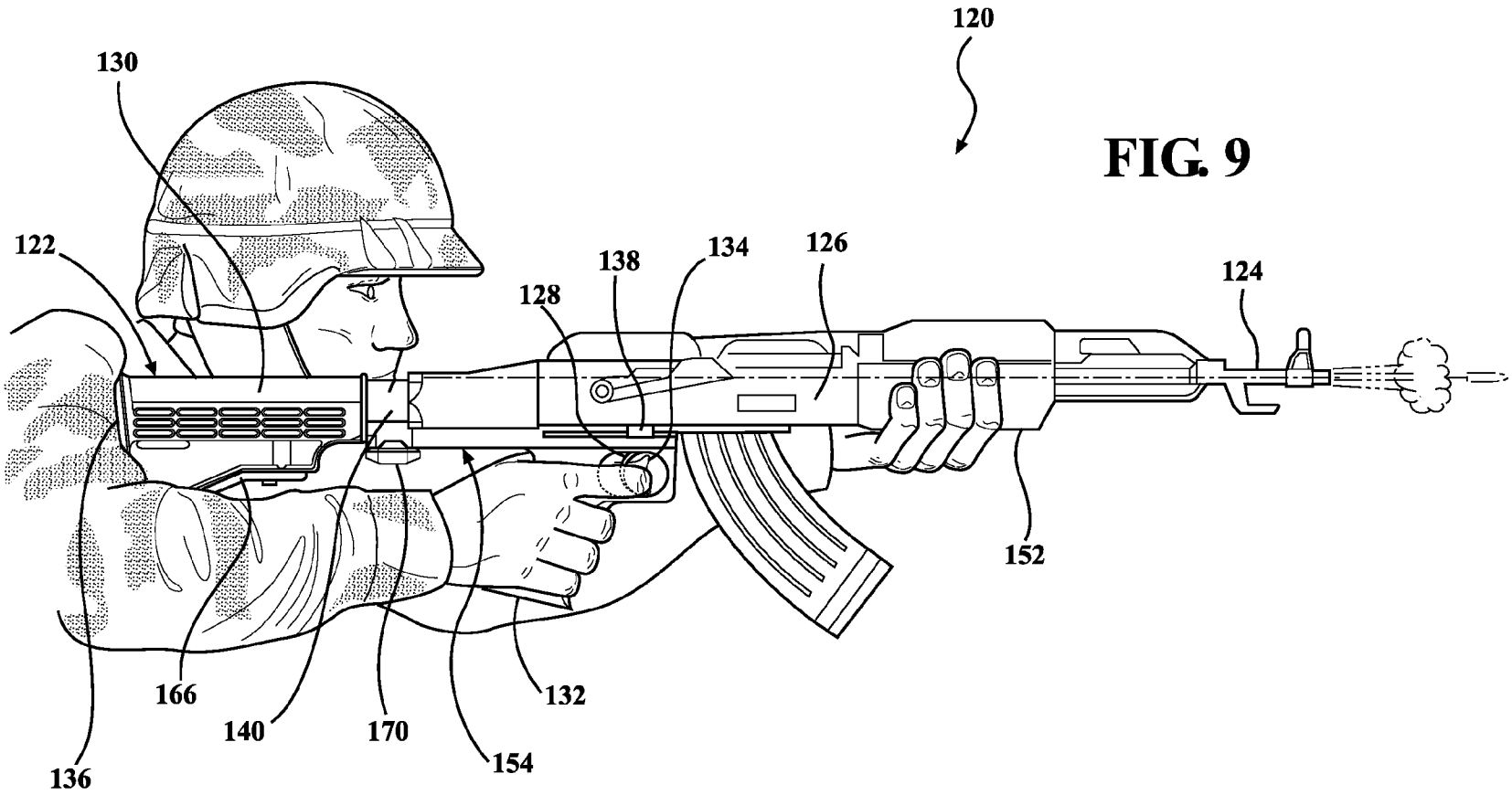
FIG. 9 is a side view of a slide-action stock assembly according to a second embodiment of this invention fitted to an AK-47 type rifle and being fired by a user.

Turning now to a second embodiment of the present invention, wherein like reference numbers offset by 100 are used to identify corresponding or similar features, a user is shown in FIG. 9 operating a semi-automatic firearm 120 configured for slide-action shooting. The second embodiment of the invention, depicted in FIGS. 9-15, is configured for use with an AK-47 or SAIGA style firearm 120. AK-47 and SAIGA platforms are also popular; however the invention may be practiced with still other makes and models of firearms with suitable modifications. As in the preceding example, the firearm 120 is composed of two main components: a firing unit and a handle unit 122. The handle unit 122 includes a shoulder stock 130 and a pistol grip 132 and a finger rest 134. The shoulder stock 130 has a rearwardly facing butt end 136 that is adapted to be pressed into the shoulder of a user, and the pistol grip 132 is grasped by the user's same hand. The end of the user's trigger finger is stretched in front of the trigger 128 of the firearm 120 and held firmly against the finger rest 134.

Figure 11:
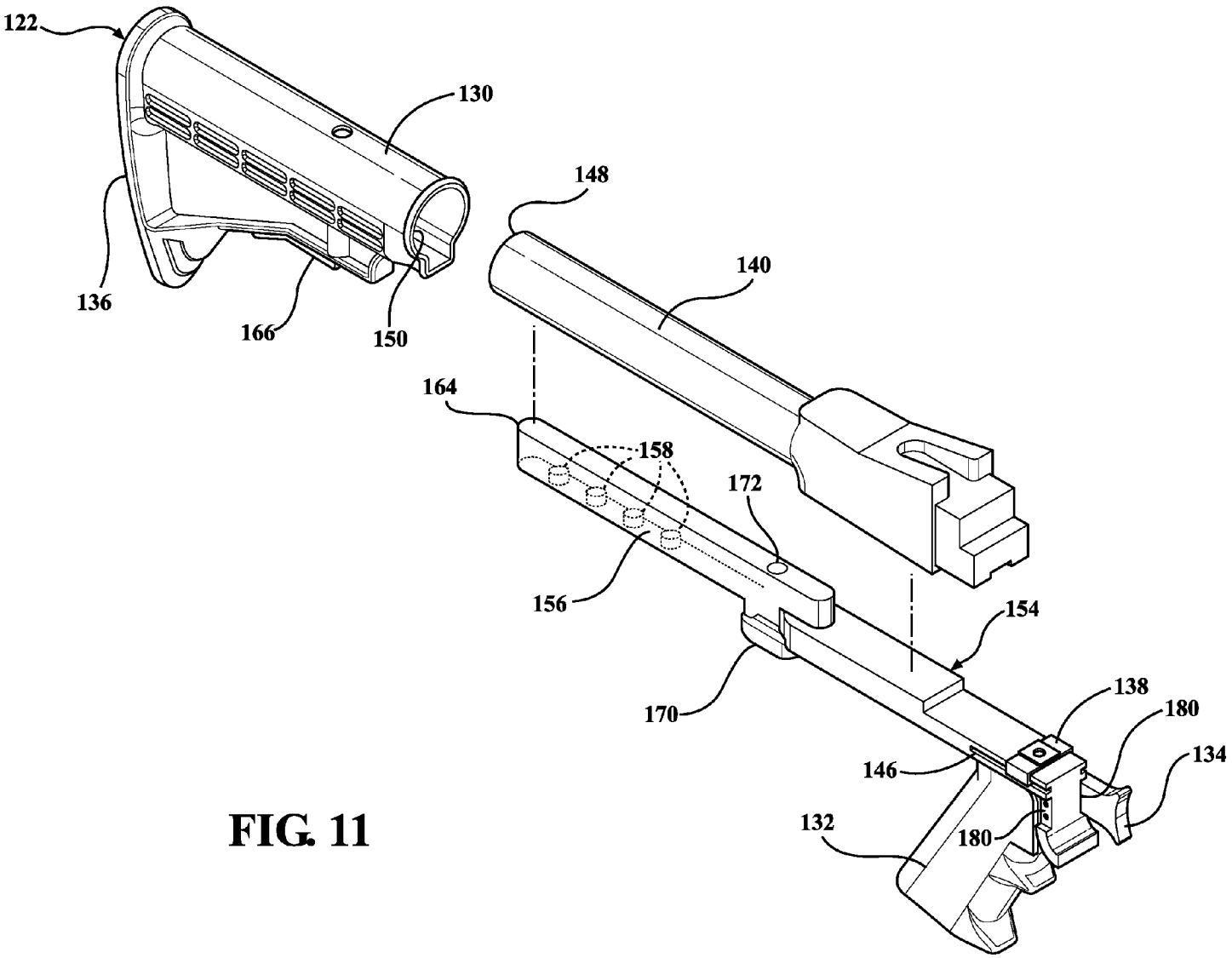
FIG. 11 is an exploded view of the assembly illustrated in FIG. 10.

A slide-action interface is established between the handle unit 122 and the firing unit, but its form differs somewhat from the first-described embodiment. Primarily, the slide-action interface takes place between the buffer tube 140 and the shoulder stock 130. In AK-platform firearms 120, the buffer assembly is housed within the box-like receiver 126; AK-47's have no buffer tube extension per se. However, an extension feature having the same general size and shape as an AR-style buffer tube 40 is attached to the rear end of the receiver 132. This extension is referred to hereafter as buffer tube 140 for convenience and consistency, it being understood that buffer tube 140 does not have the same buffer functionality as in AR firearms 20. The buffer tube 140 may be affixed to the receiver 126 in much the same way as an OE shoulder stock is affixed to an OE AK-47 firearm, i.e. at the rear end of the receiver 132. In FIG. 11, the buffer tube 140 is shown as a generally cylindrical, tube-like member that joins the receiver 126 at a forward end and that terminates at a closed rear or terminal end 148. The shoulder stock 130 is provided with a passage 150 that fits over the buffer tube 140 in a sleeve-like manner with a sliding fit.

Figure 10:
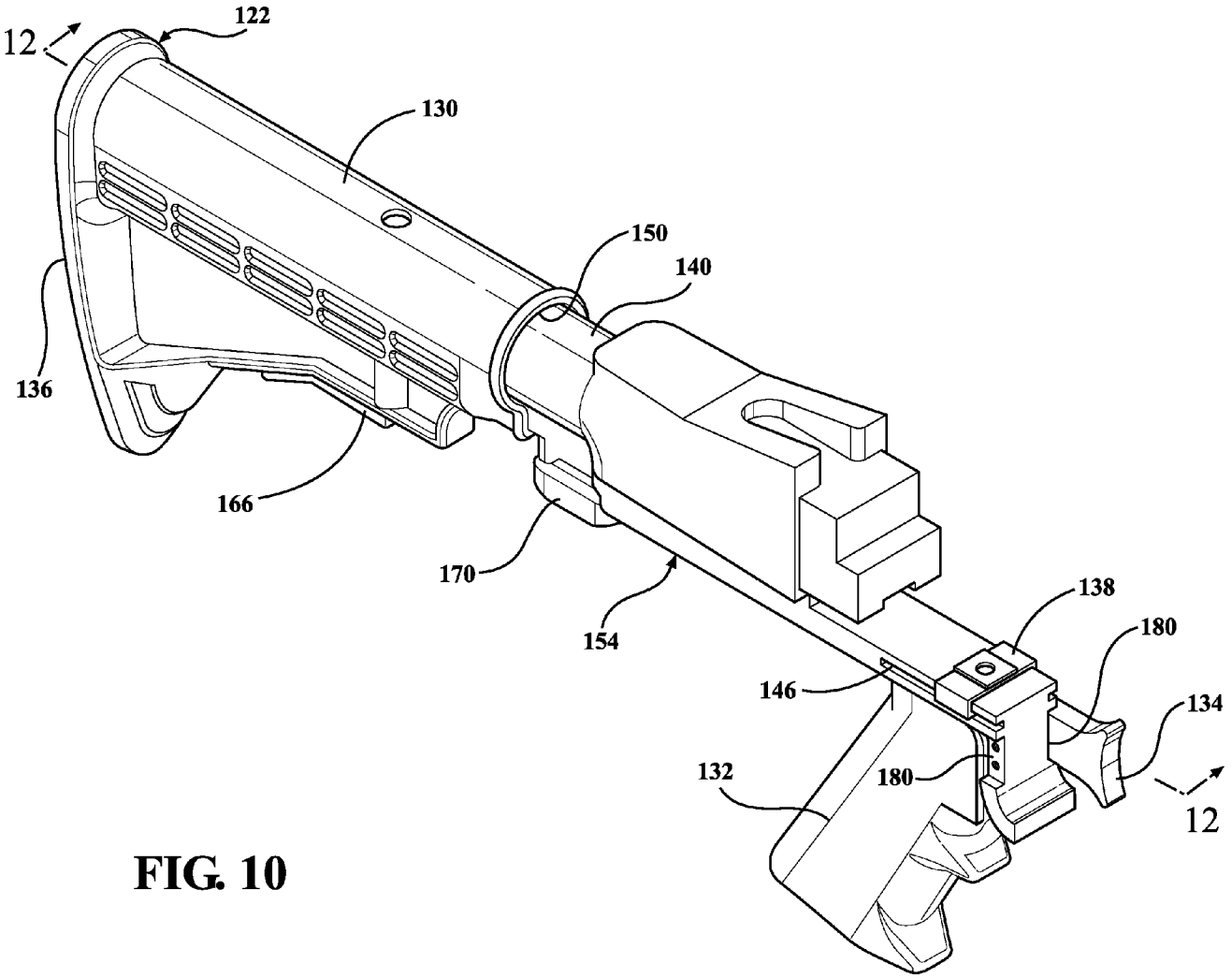
FIG. 10 is a perspective view of the slide-action stock assembly according to the second embodiment.
Figure 15:
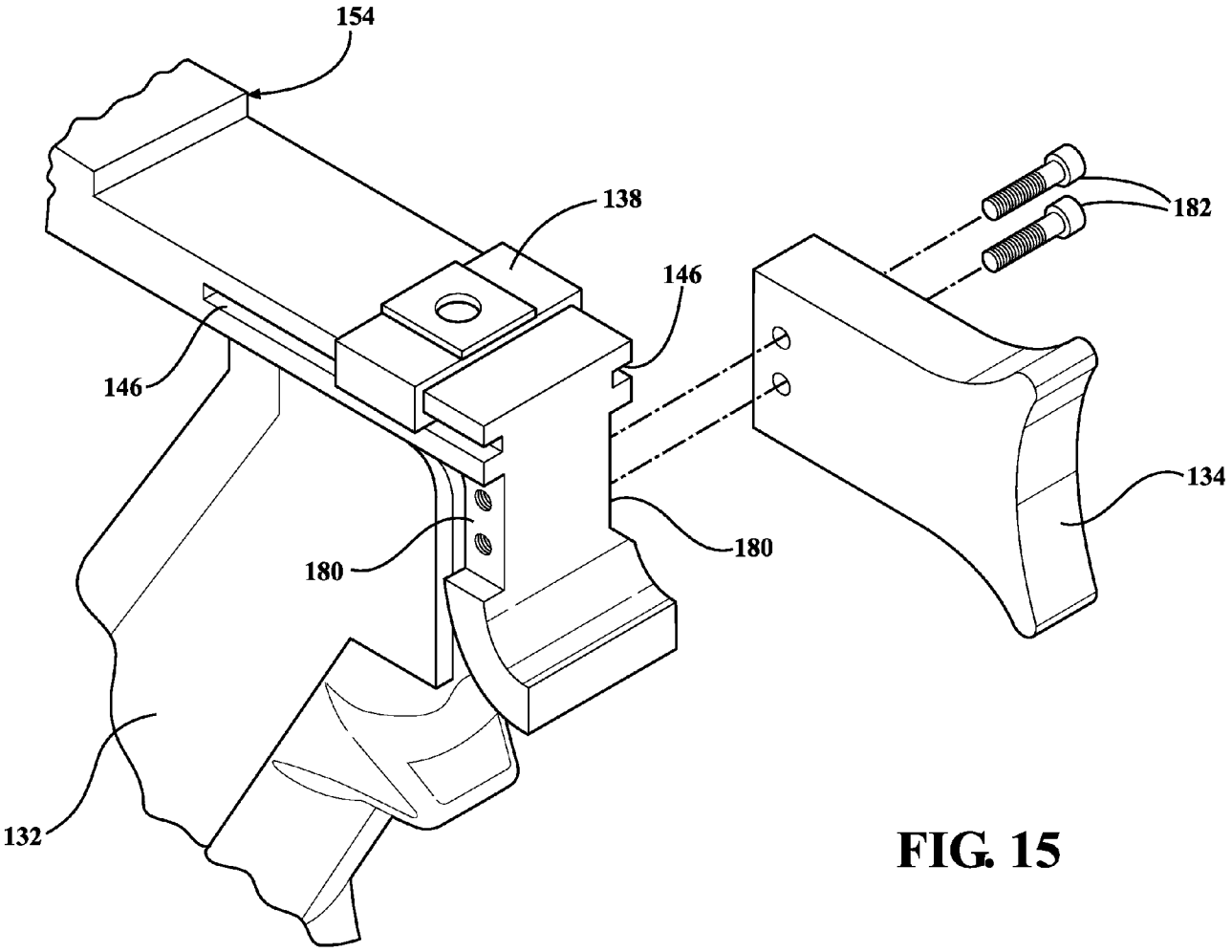
FIG. 15 is an enlarged view depicting the finger rest as it may be configured for mounting on either side of the pistol grip to accommodate left handed or right handed users.

As perhaps best shown in FIGS. 10, 11 and 15, an optional interface block 138 may be mounted by screw (not shown) to the bottom of a receiver 126. In this embodiment, the interface block 138 has a generally C-shaped configuration with its inwardly bent tips riding in a block pocket 146 in the form of slots on opposite sides of the pistol grip 132. Accordingly, the slide-action interface is established by the buffer tube 140 within the shoulder stock 130, and optionally also by the interface block 138 riding in the slots of the block pocket 146.

As with the first embodiment, here also an adjustable length interface 154 interconnects the shoulder stock 130 and the pistol grip 132, and is selectively operable by a user to change the distance between the butt end 136 of the shoulder stock 130 and the pistol grip 32, or more particularly between the butt end 136 and the trigger 128, to adapt the handle unit 22 to suit a user's comfort preference without impeding the slide-action mode of operation. The adjustable length interface 154 in this second embodiment of FIGS. 9-15 also includes an elongated stem 156 that extends rearwardly from the pistol grip 132 and underlies a bottom edge of the buffer tube 140. A plurality of adjustment holes 158 are formed in a row along the bottom of the stem 156.

A stem channel 160 slidably supports the left and right sides of the stem 156 for longitudinal reciprocating movement during slide-action operation of the firearm 120. In this second embodiment, the stem channel 160 is inset into the bottom edge of the buffer tube 140 as perhaps best shown in FIG. 12. The rearward most end of the stem channel 160 comprises a stem stop 162. A distal end 164 of the stem 156 opposes the stem stop 162 as one of possibly two or more means to limit forward movement of the firing unit in the handle unit 122.

The shoulder stock 130 may be identical in construction and operation to the shoulder stock 30 described above in connection with the first embodiment. In other words, the shoulder stock 130 includes a latch 166 that controls a spring-loaded plunger 168 to selectively engage any one of the several adjustment holes 158 in the stem 156. To adjust the trigger pull length, a user manually withdraws the plunger 168 (via the lever actuator of the latch 166) against a spring force then slides the shoulder stock 130 to a preferred adjusted length position. Upon release of the lever actuator of the latch 166, the plunger 168 seats in the nearest adjustment hole 158 thus securing the shoulder stock 130 in a new length-adjusted position.

In the slide-action mode of operation, the firing unit rapidly reciprocates within the handle unit 122, which in turn is held tight to the user's body as in FIG. 9. The slide-action interfaces, i.e., those bearing-like features that support a smooth reciprocating action, include the buffer tube 140 within the round portion of the passage 150, and the stem channel 160 flanking the stem 156, and (if included) the interface block 138 within the block pocket 146. These interacting surfaces operate in concert to maintain a smooth and stable sliding action.

As mentioned above, the pistol grip 132 and finger rest 134 and stem 156 portions may be composed of interconnecting and interchangeable modules.

Figure 12:
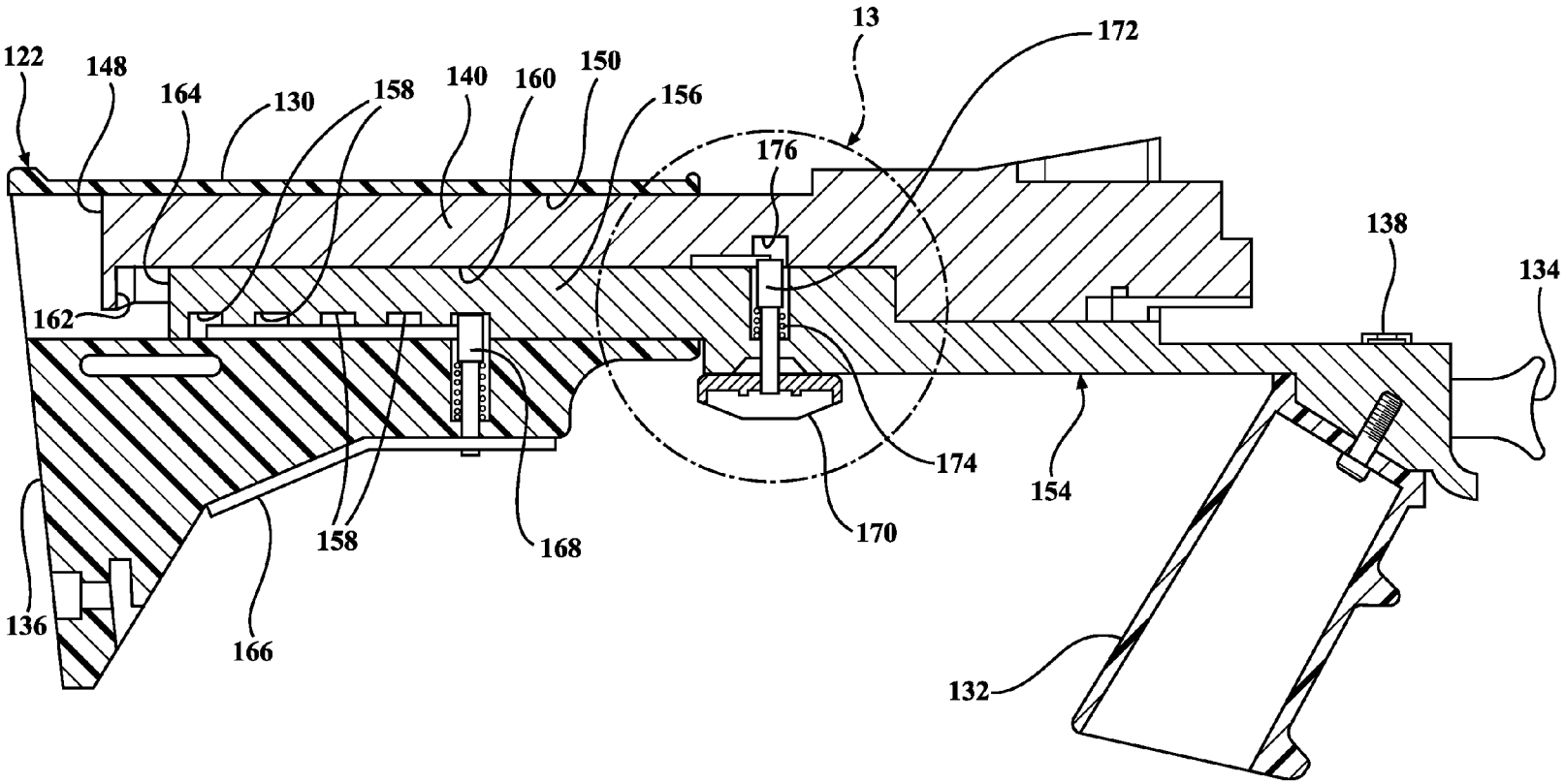
FIG. 12 is a cross-sectional view taken generally along lines 12-12 of FIG. 10.
Figure 13:
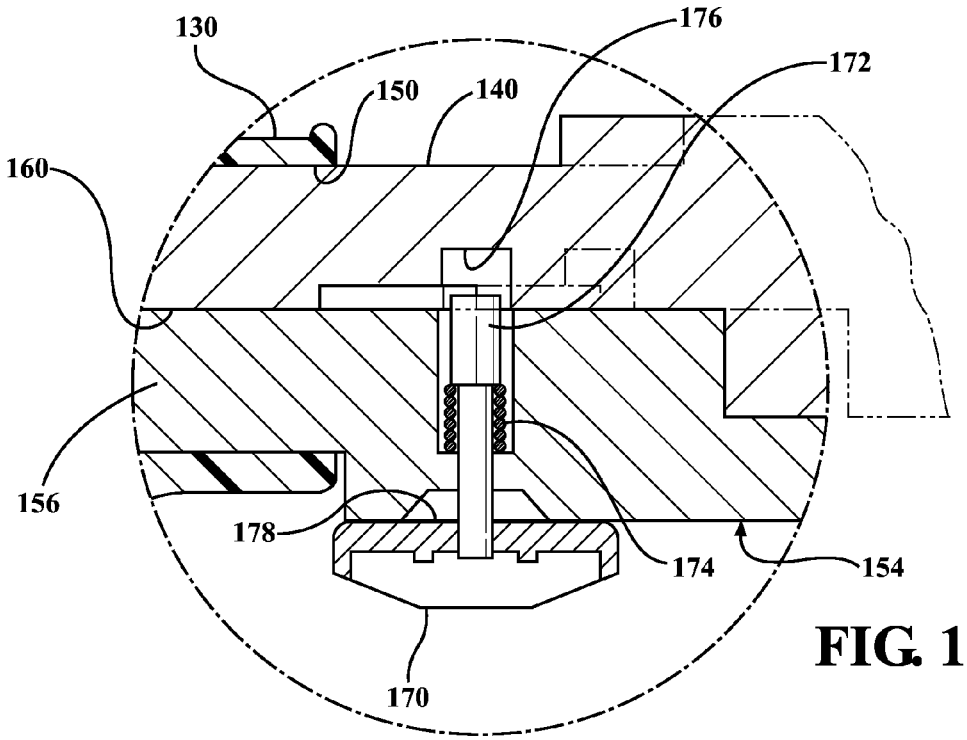
FIG. 13 is an enlarged view of the area circumscribed at 13 in FIG. 12, and showing the buffer tube element shifted to the right in phantom as during the slide-action mode of operation.
Figure 14:
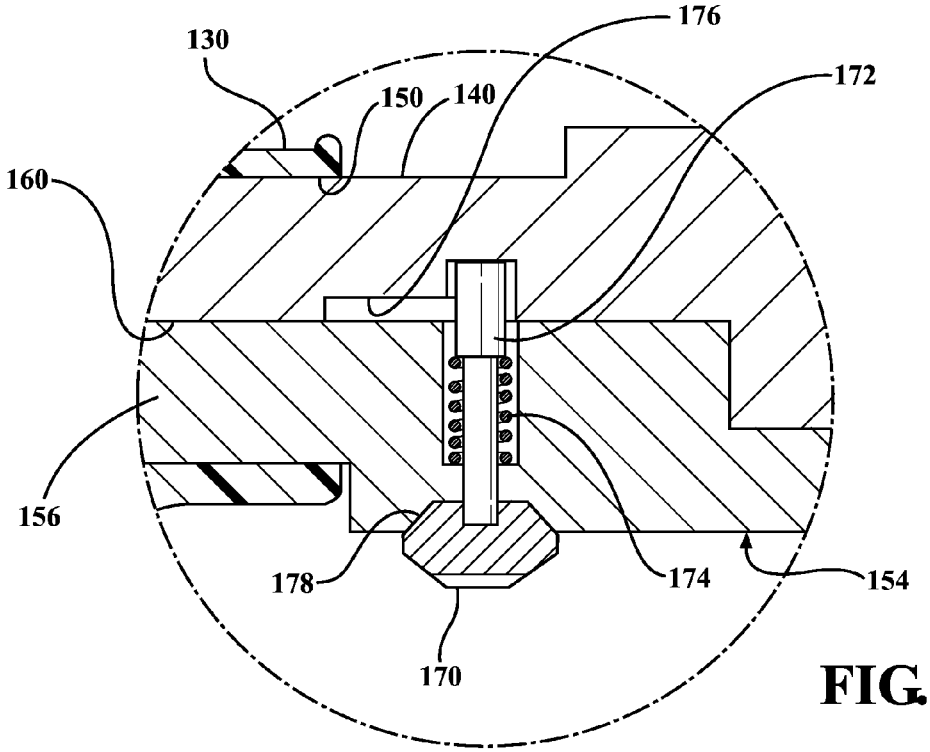
FIG. 14 is a view as in FIG. 13 but showing the lock-out feature in an engaged position thereby impeding the slide-action mode of operation.

FIGS. 12-14 depict a lock-out feature of the present invention which can be selectively activated by the user to prevent relative reciprocating action between the firing unit and the handle unit 122 so as to impede the slide-action mode of operation. A user may wish to activate the lock-out feature, for example, when transporting the firearm 120, before handing the firearm 120 to another person, or when shooting in the more traditional single-shot mode. The lock-out feature includes a lock switch 170 movable toward and away from a locked position for selectively stopping reciprocating movement of the stem 156 relative to the stem channel 160. The lock-out feature can take many different forms and enjoy implementation in various ways. The one representative implementation illustrated in the second embodiment depicts the lock switch 170 directly attached to a retractable pin 172. The lock switch 170 is exposed on the under-surface of the stem 156, and the retractable pin 172 extends upwardly therefrom through a vertical hole in the stem 156. A spring 174 acts between the retractable pin 172 and the stem 156 to constantly bias the retractable pin 172 in an upward direction.

The underside of the buffer tube 140 is provided with a socket 176 directly about the retractable pin 172. The forward-most end of the socket 176 is formed with a deep well section sized and shaped to receive a considerable length of the retractable pin 172. The remaining portions of the socket 176 are considerably shallower and are sized and shaped in a somewhat oval geometry to receive only the tip of the retractable pin 172. The overall length of the socket 176 is generally equal to, or perhaps slightly longer than, the back-and-forth reciprocating travel of the firing unit within the handle unit 122 as illustrated in FIG. 9. FIG. 13 depicts this relative movement in phantom lines, where the portion of buffer tube 140 slides back-and-forth (shown here as left and right motion) while the socket 176 travels unhindered over the retracted tip of the pin 172. However, movement of the lock switch 170 toward the locked position causes the attached pin 172 to rise (as shown in FIG. 14) so that its tip enters the deep well section of the socket 176. The presence of the pin 172 within the close-fitting deep well section of the socket 176 effectively immobilizes the ability for the firing unit to reciprocate within the handle unit 122. Movement of the lock switch 170 toward and away from its locked positions can be accomplished in any number of ways. One such way illustrated in FIGS. 13 and 14 is by forming the lock switch 170 with cam surface 178 that rides against an opposing depressed region on the lower side of the stem 156. A quarter-rotation of the lock switch 170 will cause the tip of the pin 172 to extend up into the deep well region of the socket 176 (FIG. 14) or pull down to the retracted position (FIG. 13), as aided by the continual upward push of the spring 174.

Although not shown, a similar lock-out feature can be integrated into the first embodiment of FIGS. 1-8, or a completely different lock-out strategy can be used to achieve substantially similar lock-out results in any of the disclosed embodiments.

Turning now to FIG. 15, another novel feature of this invention is depicted. As shown here, the finger rest 134 may be designed for selective placement on either the left or right sides of the pistol grip 132 to accommodate left-handed or right-handed users. While this feature can be implemented in a variety of ways, the one way shown here includes forming the pistol grip 132 with left and right notches 180. The finger rest 134 is structured as a loose-piece element that can be installed in either notch 180. The design can be self-locking, or as shown here include one or more threaded fasteners 182 to selectively affix the finger rest 134 in position within the left or right notch 180 above of the pistol grip 180.

In addition to the physical structure described above in several alternative embodiments, the invention also contemplates a method for supporting the firing unit portion of a semi-automatic firearm 20, 120 for slide-action rapid fire. The firearm 20, 120 is of the type having a firing unit comprising a barrel 24, 124 and a trigger 28, 128 and a receiver 26, 126. A shoulder stock 30, 130 and a pistol grip 32, 132 and a finger rest 34, 134 are connected together as a handle unit 22, 122. The shoulder stock 30, 130 is of the type having a rearwardly facing butt end 36, 136. The method includes supporting the firing unit in the handle unit 22, 122 for longitudinal reciprocating movement when in a rapid-fire slide-action mode of operation. The improvement of the method comprises the step of adjusting the distance between the butt end 36, 136 of the shoulder stock 30, 130 and the pistol grip 32, 132 to adapt the handle unit 22, 122 to suit a user's comfort preference without impeding the slide-action mode of operation. For example, tall users may prefer to have the shoulder stock 30, 130 adjusted further rearward, whereas shorter users may prefer to have the shoulder stock 30, 130 adjusted forward.

The supporting step preferably includes the step of extending a buffer tube 40, 140 from the receiver portion 26, 126 of the firing unit, and slidably surrounding at least a portion of the buffer tube 40, 140 with the shoulder stock 30, 130. An elongated stem 56, 156 is interposed between the shoulder stock 30, 130 and the buffer tube 40, 140. The stem 56, 156 includes a plurality of adjustment holes 58, 158. The shoulder stock 30, 130 includes a plunger 68, 168 that is selectively engageable with one of the plurality of adjustment holes 58, 158 in the stem 56, 156. The method may optionally also include the step of relocating the finger rest 34, 134 from the left side of the pistol grip 32, 132 to the right side of the pistol grip 32, 132, or vise-versa.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. A slide-action stock assembly for a semi-automatic firearm having a longitudinally reciprocating trigger, said assembly comprising:

a shoulder stock having a rearwardly facing butt end adapted to be pressed into the shoulder of a user, a pistol grip adapted to be grasped by the user's hand, a finger rest configured to stabilize the end of a user's trigger finger stretched in front of the trigger of the firearm while the remaining fingers of the user's hand clench said pistol grip, said shoulder stock and said pistol grip and said finger rest selectively fixable together as a unit relative to the longitudinally reciprocating firearm trigger when in a rapid-fire slide-action mode of operation, and an adjustable length interface interconnecting said shoulder stock and said pistol grip, said adjustable length interface selectively operable to change the distance between said butt end of said shoulder stock and said pistol grip to adapt said assembly to suit a user's comfort preference without impeding the slide-action mode of operation.

2. The assembly of claim 1 wherein said adjustable length interface includes an elongated stem extending rearwardly from said pistol grip, said shoulder stock at least partially surrounding said stem, said stem including a plurality of adjustment holes, and said shoulder stock including a plunger selectively engageable with one of said plurality of adjustment holes in said stem.

3. The assembly of claim 2 further including a stem channel slidably supporting said stem for reciprocating movement during slide-action operation of said firearm.

4. The assembly of claim 3 wherein said stem channel is disposed on a buffer tube, and said shoulder stock slidably surrounding at least a portion of said stem channel and said buffer tube.

5. The assembly of claim 3 wherein said buffer tube has a generally cylindrical exterior surface including a bottom edge, said stem channel disposed along said bottom edge of said buffer tube.

6. The assembly of claim 4 wherein said stem includes a distal end, said stem channel including a stem stop positioned to abut said distal end of said stem and thereby limit the longitudinal reciprocating movement therebetween.

7. The assembly of claim 3 further including a lock switch movable toward and away from a locked position for selectively stopping reciprocating movement of said stem relative to said stem channel and thereby impede the slide-action mode of operation.

8. The assembly of claim 7 further including a retractable pin moveable in direct response to movement of said lock switch, and a spring acting between said retractable pin and said stem.

9. The assembly of claim 8 wherein said lock switch includes cam acting between said retractable pin and said stem.

10. The assembly of claim 1 wherein said pistol grip has left and right sides, said finger rest including at least one fastener configured to selectively affix to said left and right sides of said pistol grip.

11. A slide-action stock assembly for a semi-automatic firearm having a longitudinally reciprocating firing unit, said assembly comprising:

a buffer tube adapted for connection to the firing unit of the semi-automatic firearm so that said buffer tube longitudinally reciprocates in concert with the firing unit, a shoulder stock having a rearwardly facing butt end adapted to be pressed into the shoulder of a user, said shoulder stock slidably surrounding at least a portion of said buffer tube, a pistol grip adapted to be grasped by the user's hand, a finger rest configured to stabilize the end of a user's trigger finger stretched in front of the trigger of the firearm while the remaining fingers of the user's hand clench said pistol grip, said shoulder stock and said pistol grip and said finger rest selectively fixable together as a handle unit, a slide-action interface operatively disposed between said handle unit and said buffer tube for enabling longitudinally reciprocating movement of said buffer tube relative to said handle unit when in a rapid-fire slide-action mode of operation, and an adjustable length interface interconnecting said shoulder stock and said pistol grip, said adjustable length interface selectively operable to change the distance between said butt end of said shoulder stock and said pistol grip to adapt said assembly to suit a user's comfort preference without impeding said slide-action interface.

12. The assembly of claim 11 wherein said adjustable length interface includes an elongated stem extending rearwardly from said pistol grip, said shoulder stock at least partially surrounding said stem, said stem including a plurality of adjustment holes, and said shoulder stock including a plunger selectively engageable with one of said plurality of adjustment holes in said stem.

13. The assembly of claim 12 wherein said buffer tube includes a stem channel, said stem channel slidably supporting said stem for reciprocating movement during slide-action operation of said firearm.

14. The assembly of claim 13 wherein said buffer tube has a generally cylindrical exterior surface including a bottom edge, said stem channel disposed along said bottom edge of said buffer tube.

15. The assembly of claim 13 wherein said stem includes a distal end, said stem channel including a stem stop positioned to abut said distal end of said stem and thereby limit the longitudinal reciprocating movement therebetween.

16. The assembly of claim 11 further including a lock switch movable toward and away from a locked position for selectively stopping reciprocating movement of said shoulder stock relative to said buffer tube and thereby impede the slide-action mode of operation.

17. The assembly of claim 11 wherein said pistol grip has left and right sides, said finger rest including at least one fastener configured to selectively affix to said left and right sides of said pistol grip.

18. A method for supporting the firing unit portion of a semi-automatic firearm for slide-action rapid fire, said method comprising the steps of:

providing a semi-automatic firearm having a firing unit comprising a barrel and a trigger and a receiver, connecting a shoulder stock and a pistol grip and a finger rest together as a handle unit, the shoulder stock having a rearwardly facing butt end, supporting the firing unit in the handle unit for longitudinal reciprocating movement when in a rapid-fire slide-action mode of operation, and adjusting the distance between the butt end of the shoulder stock and the pistol grip to adapt the handle unit to suit a user's comfort preference without impeding the slide-action mode of operation.

19. The method of claim 18 wherein said supporting step includes extending a buffer tube from the receiver portion of the firing unit, slidably surrounding at least a portion of the buffer tube with the shoulder stock, interposing an elongated stem between the shoulder stock and the buffer tube, the stem including a plurality of adjustment holes, and the shoulder stock including a plunger selectively engageable with one of the plurality of adjustment holes in the stem.

20. The method of claim 18 wherein the pistol grip has left and right sides, further including relocating the finger rest from one of the left and right sides to the other of the left and right sides of the pistol grip.

* * * * *